US007325370B2

(12) United States Patent
Redmond

(10) Patent No.: US 7,325,370 B2
(45) Date of Patent: Feb. 5, 2008

(54) MACHINE TO MAKE E-Z OPEN POUCH WITH FLAP AND BULGE

(75) Inventor: Sanford Redmond, Stamford, CT (US)

(73) Assignee: Sanford Redmond, Inc., Stamford, CT (US)

( * ) Notice: Subject to any disclaimer, the term of this patent is extended or adjusted under 35 U.S.C. 154(b) by 0 days.

(21) Appl. No.: 11/430,040

(22) Filed: May 9, 2006

(65) Prior Publication Data

US 2006/0201106 A1 Sep. 14, 2006

Related U.S. Application Data

(62) Division of application No. 10/733,306, filed on Dec. 12, 2003, now Pat. No. 7,069,705.

(60) Provisional application No. 60/433,007, filed on Dec. 13, 2002.

(51) Int. Cl.
*B65B 61/18* (2006.01)
*B65B 9/02* (2006.01)

(52) U.S. Cl. ..... 53/133.8; 53/133.3; 53/554; 53/559; 53/375.2; 53/377.6

(58) Field of Classification Search ..... 53/553–555, 53/133.1–133.3, 133.7, 133.8, 559, 561
See application file for complete search history.

(56) References Cited

U.S. PATENT DOCUMENTS 2,310,382 A 2/1943 Allen
2,311,017 A 2/1943 Anderson
2,350,930 A * 6/1944 Salflsberg ..... 53/554
2,613,022 A 10/1952 Peterson
2,917,879 A * 12/1959 Aubin ..... 53/554
3,245,197 A 4/1966 Van Mill, Jr. et al.
3,453,661 A 7/1969 Repko
3,505,705 A 4/1970 Stroop
3,596,428 A * 8/1971 Young et al. ..... 53/553
RE31,853 E * 3/1985 Vande Castle ..... 53/387.3
4,604,854 A 8/1986 Andreas
4,676,051 A * 6/1987 Hoskinson et al. ..... 53/374.9
4,700,532 A 10/1987 Redmond
4,720,014 A 1/1988 Redmond
4,722,166 A 2/1988 Dieckow
4,819,406 A 4/1989 Redmond
4,996,819 A * 3/1991 Davis ..... 53/554
5,364,484 A 11/1994 Redmond
5,724,789 A * 3/1998 Corella ..... 53/553
5,779,110 A 7/1998 Brown et al.
5,813,197 A 9/1998 Aguzzoli (Continued)

FOREIGN PATENT DOCUMENTS

WO WO 01/07325 A1 2/2001

(Continued)

*Primary Examiner*—Stephen F. Gerrity
(74) *Attorney, Agent, or Firm*—Kenyon & Kenyon LLP

(57) ABSTRACT

A form-fill-seal machine for making a pouch style package is provided, comprising an optional bulge forming station for forming a puff or bulge; a heating and filling station for creating seals and filling the pouch; and an optional flap making station comprising a mechanism for folding over a flap and sealing the inside portion of the flap to the front face of the pouch.

17 Claims, 13 Drawing Sheets

U.S. PATENT DOCUMENTS 5,826,737 A 10/1998 Zakensberg
6,244,467 B1 6/2001 Lewit
6,314,706 B1 11/2001 Araki et al.
6,408,599 B1 6/2002 Nakagawa et al.
6,415,939 B1 7/2002 Redmond
2002/0195461 A1 12/2002 Redmond

FOREIGN PATENT DOCUMENTS

WO WO01/36293 A1 5/2001

* cited by examiner

SLITTING CRUSH ROLLERS TYP.

POSITION #2

POSITION #1

POSITION #4

POSITION #3

MACHINE TO MAKE E-Z OPEN POUCH WITH FLAP AND BULGE

CROSS-REFERENCE TO RELATED APPLICATIONS

This application is a Divisional of U.S. patent application Ser. No. 10/733,306, filed Dec. 12, 2003, now U.S. Pat. No. 7,069,705, which claims priority to U.S. Provisional Patent Application Ser. No. 60/433,007, filed Dec. 13, 2002, entitled "Machine to Make E-Z Open Pouch with Flap and Bulge," the disclosures of which are hereby incorporated herein by reference.

FIELD OF THE INVENTION

The invention relates to machines and processes for the production of sachet or pouch style packages similar to those commonly used for condiments such as ketchup as well as other products.

BACKGROUND OF THE INVENTION

The inventor of the machines and processes described and claimed herein is also the inventor of new designs for sachet or pouch style packages. Certain of those designs and films for use with those designs are described and/or claimed in U.S. Pat. No. 6,415,939 and U.S. patent application Ser. No. 10/189,595, now U.S. Pat. No. 6,685,058, the disclosures of which are hereby expressly incorporated herein by reference. Films as described in U.S. Pat. No. 6,415,939 and U.S. patent application Ser. No. 10/189,595, now U.S. Pat. No. 6,685,058, include relatively thin plastics and foils or combinations of laminated plastics and foils.

FIG. 62A through FIG. 67 of U.S. Pat. No. 6,415,939 show some examples of sachet or pouch style packages having a location for an outlet aperture in or on one wall or face of the package, that outlet location being covered by a flap member. The flap member covers an outlet or outlet creating means at the outlet location. The outlet location is in or on the same wall or face of the package that forms a wall or face of the flap member, and the flap member is folded over and sealingly attached to or around the outlet location such that the two portions of the same surface of film are sealed together. The outlet is opened by raising the flap member.

There is a need for these and similar packages to be produced efficiently on high speed production equipment.

SUMMARY OF THE INVENTION

In certain embodiments of the invention, a machine and process are provided for manufacturing a sachet or pouch style package with a foldover flap.

In certain embodiments of the invention, a machine and process are provided for manufacturing a sachet or pouch style package requiring various sizes similar to prior sachet or pouch style packages, except that the subject machine will be capable of creating an outlet aperture or outlet creating means in one wall or face of said sachet, covered by a flap member covering said outlet or outlet creating means and being sealingly attached to its own same surface over and/or around said outlet creating means, which outlet would be created by raising said flap. Embodiments are provided capable of producing packages as described and/or claimed in U.S. Pat. No. 6,415,939.

The machine may have the capability of forming a bulge or puff in at least one wall of said pouch to increase its volumetric capacity. It will also be realized that the embodiments of the machine will handle heavier gauge films than those utilized to produce prior sachets, in order for the packages to have a degree of rigidity to maintain specific shapes.

DETAILED DESCRIPTION

A machine in accordance with certain embodiments of the invention has the capability of supporting and intermittently controllably feeding specific lengths of packaging material, mainly plastic film, from rolls, the packaging material having the strength to be indexed or drawn through said machine by draw rollers even when heated to sealing temperatures. The machine's functions is controlled by a PLC and has a servo or stepper motor for indexing the film, in addition to pneumatics including air activated cylinders as well as a vacuum pump or source. As will be appreciated, certain operations as described below preferably take place during the rest period between indexes.

Figure 1:
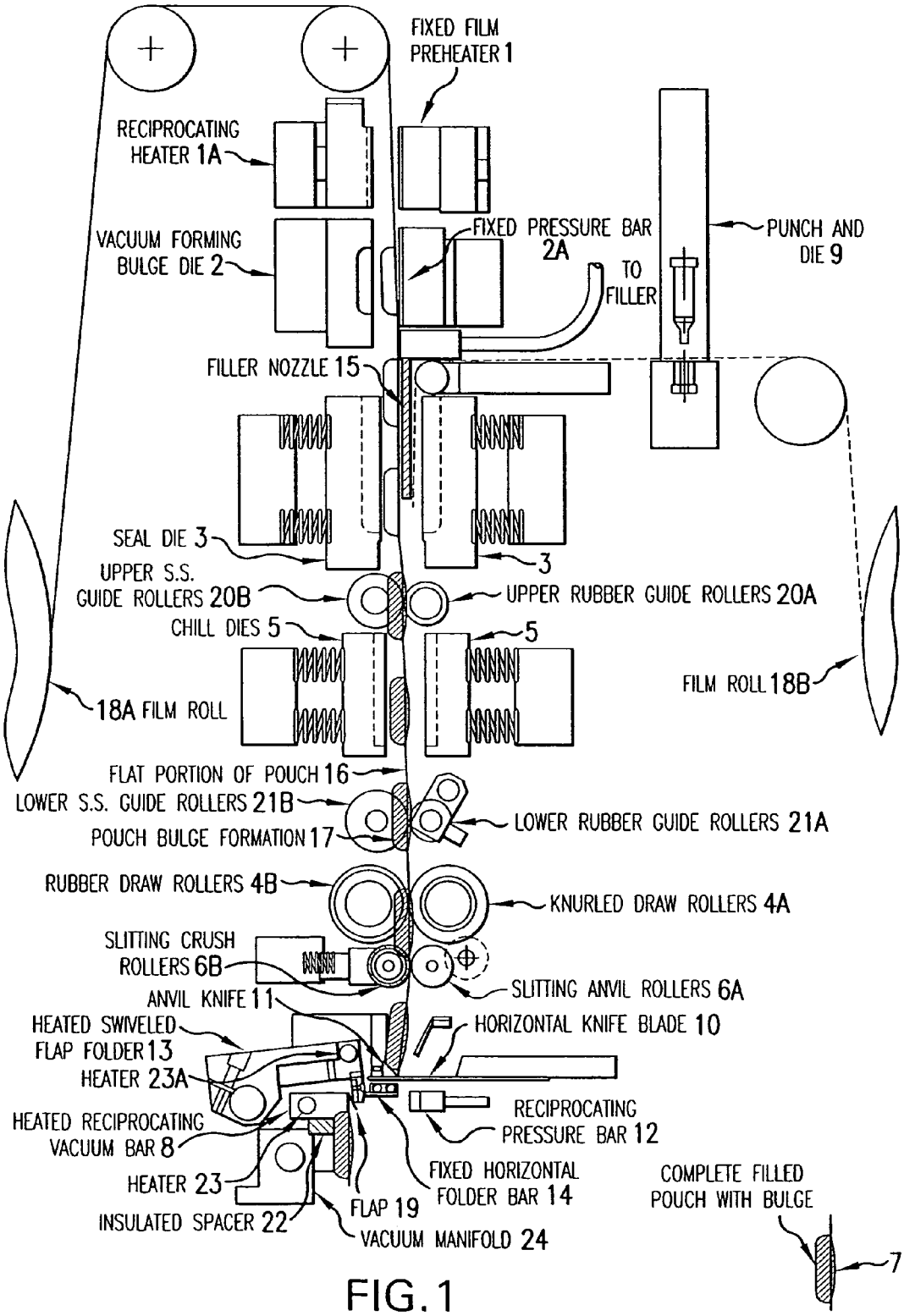
FIG. 1 shows a schematic depiction of a machine in accordance with an embodiment of the invention, incorporating inventive elements.

An example of a high speed form-fill-seal machine incorporating inventive elements is shown in FIG. 1. The machine draws a first film from a first film roll 18A and a second film from a second film roll 18B.

Initially, the first film passes through a heating station comprising a fixed film preheater 1 and a reciprocating heater 1A. This station heats the film for formation of a bulge. Next, the first film is brought into a bulge forming station comprising a fixed pressure bar 2A and a vacuum forming bulge die. The plastic of the film is forced into the die, thermoforming a puff or bulge 17 in the film. The pressure bar (or plate) 2A may be covered with a resilient rubber-like layer. The heating station may be considered part of the bulge forming station since that is where the film is heated to facilitate the thermoforming. Embodiments of the machine may, of course, make pouches without a bulge or puff.

The second film enters an outlet means creating station comprising a punch and die 9 or other means to create an outlet aperture or score or fault line or other aperture creating means in the second film. The aperture, score or fault line, or other aperture creating means is preferably made during the rest period between indexes, although it may be created at other times as well. The second film is then fed to join the first film at a filling and sealing station comprising a set of reciprocating seal dies 3.

Figure 8C:
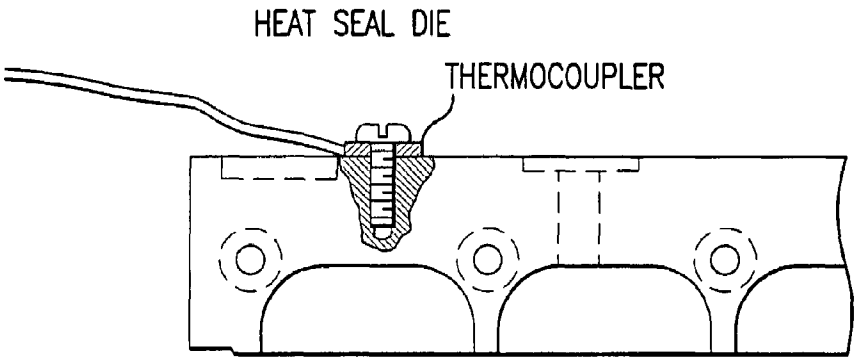
FIG. 8C is a top view of the heat seal die of FIG. 8A.
Figure 8B:
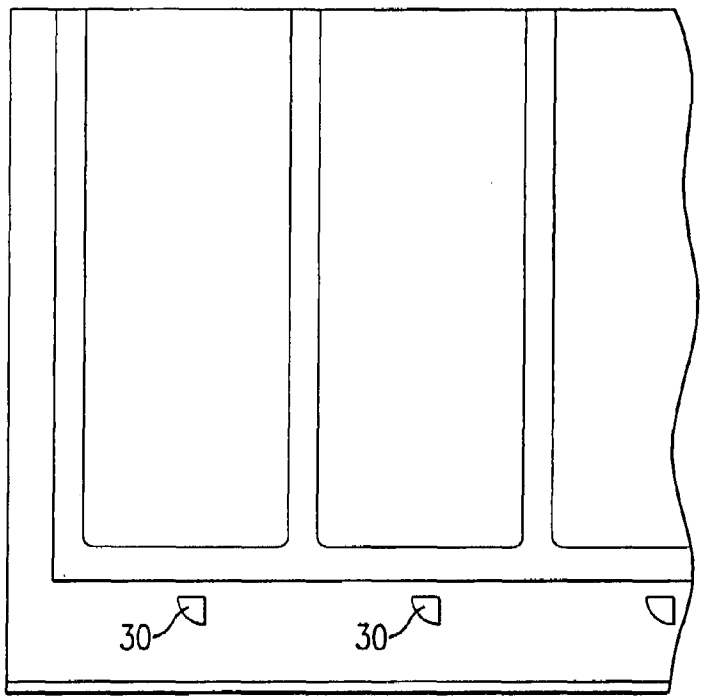
FIG. 8B is a front view of the heat seal die of FIG. 8A.
Figure 8A:
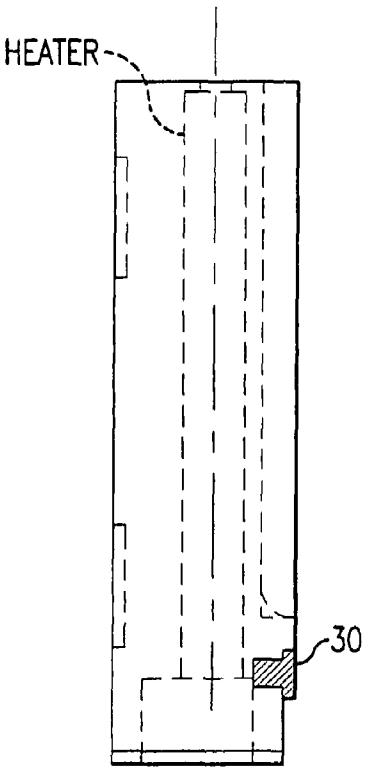
FIG. 8A is an enlarged end view of one of the heat seal dies of the machine of FIG. 1.

Extending downward between each package defined by the vertical heat seal, between the reciprocating seal dies 3, which are shown in FIGS. 8A-8C, may be a filler nozzle 15. The filler nozzle 15 connects to a filler which dispenses the flowable product to be packaged (for example ketchup, shampoo, or any of a number of other possible products). It will be realized that as in the forming station one of the sealing dies may be fixed and only one of the dies reciprocating.

The filling means comprising filler nozzle 15 supplies the flowable product to the packages after the set of reciprocating seal dies 3 come together to create a lower seal and a pair of parallel edge seals in a squared "U" configuration about each filler nozzle 15. In this manner, the seal dies 3 seal the first film and second film together forming a pouch to be filled.

The filling means fill a controlled quantity of product to a specific level in the dispensing package, which in this embodiment is not beyond the top of the bulge. It will be appreciated that at this stage the package has a flat length of the package walls 16 which will ultimately become the flap and a portion of the pouch.

At each index, the lower surface of the sealing dies 3 creates a double width horizontal seal which comprises the lower seal of one pouch and simultaneously comprising the upper seal of the preceding pouch. That is, the product-containing area of the preceding pouch (the pouch that just exited the seal die) is sealed at the top by the lower surface of the sealing dies 3.

At the following index, after passing through a set of guide rollers 20A, 20B, a set of chill dies 5 act to chill or cool the hot seals of the pouches to set them. At the next index, the now filled and sealed members, after again possibly passing through another set of guide rollers 21A, 21B, are drawn through suitable slitting means, just at or subsequent to the pouch passing through the draw roller station, by means of driven crush cutter rollers 6 (the drawing depicts slitting anvil rollers 6A and slitting crush rollers 6B). The draw rollers 4 (knurled metal draw rollers 4A and rubber draw rollers 4B) are generally narrow, since they preferably will only draw the filled pouches along the narrow edge seal area. It will be seen that sets of guide rollers are placed just beneath each of the vertical heat seals after being created. Guide rollers may also be located beneath the chill dies to maintain the proper tracking of the various film utilized.

Figure 2:
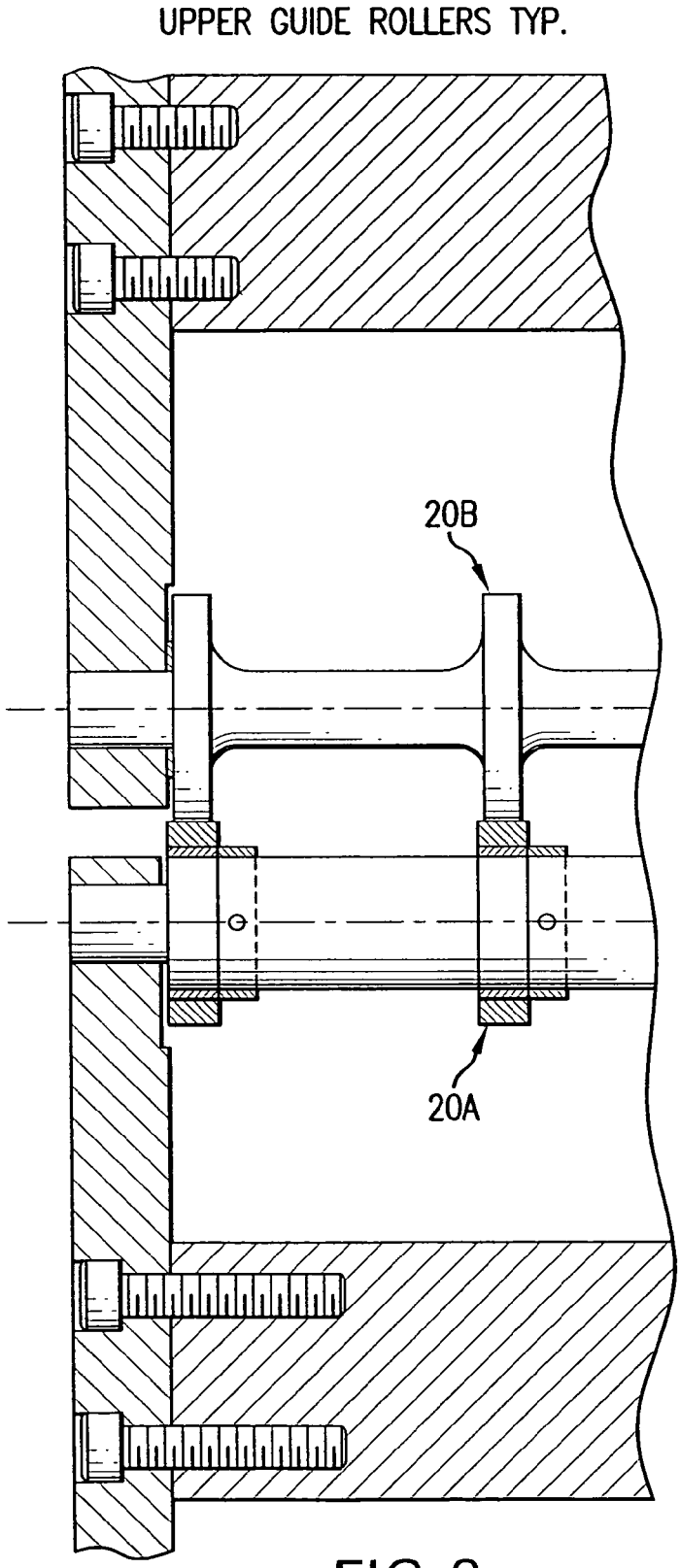
FIG. 2 is an enlarged view of upper guide rollers of the machine of FIG. 1.
Figure 3:
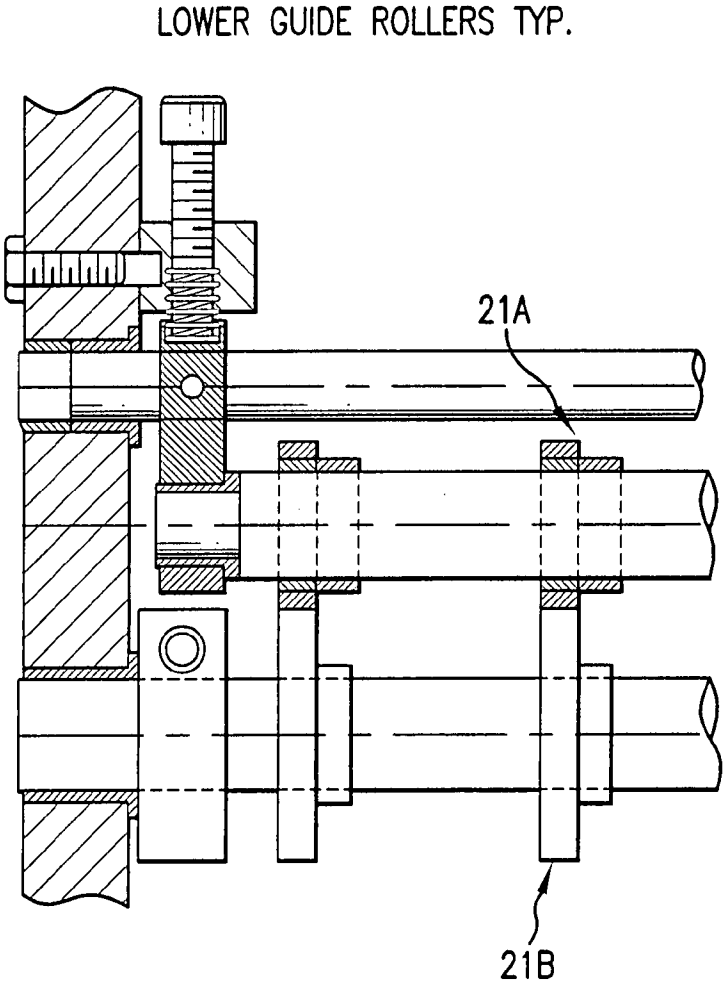
FIG. 3 is an enlarged view of lower guide rollers of the machine of FIG. 1.
Figure 4:
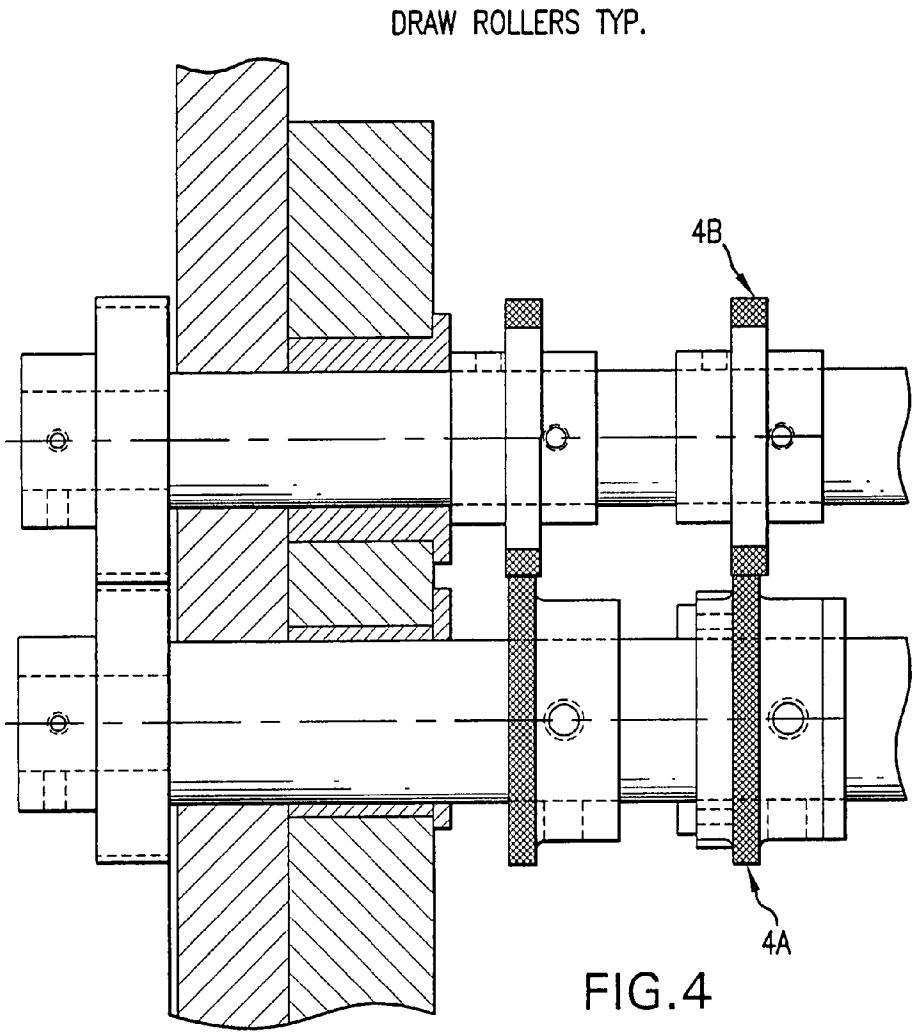
FIG. 4 is an enlarged view of draw rollers of the machine of FIG. 1.
Figure 5:
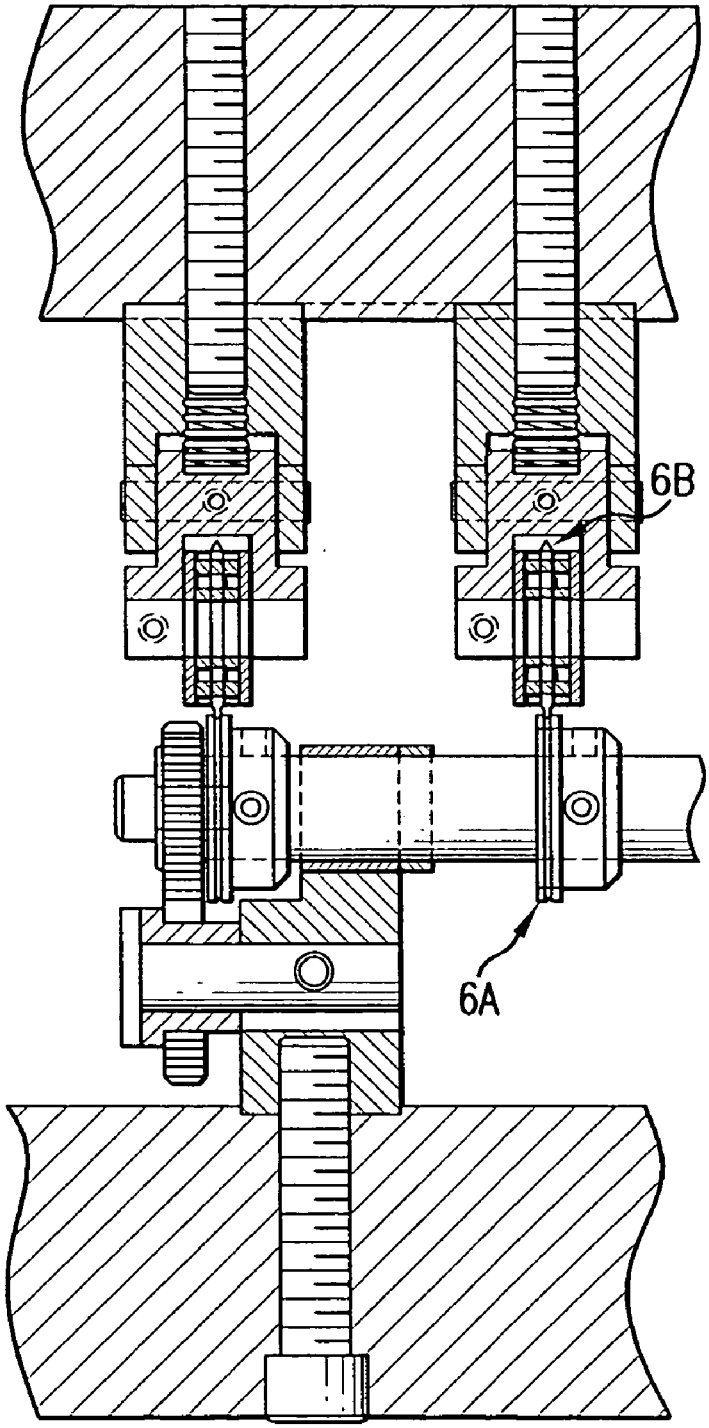
FIG. 5 is an enlarged view of slitting crush rollers of the machine of FIG. 1.

FIG. 2 is an enlarged view of the upper guide rollers, comprising upper rubber guide rollers 20A and upper stainless steel guide rollers 20B. FIG. 3 is an enlarged view of the lower guide rollers, comprising lower rubber guide rollers 21A and lower stainless steel guide rollers 21B. FIG. 4 is an enlarged view of the draw rollers, comprising knurled draw rollers 4A and rubber draw rollers 4B. FIG. 5 is an enlarged view of the slitting crush rollers 6B and slitting anvil rollers 6A. The anvil rollers 6A may have a groove to track the "V" shaped crush rollers 6B. As shown, each crush roller 6B is spring loaded independently.

Figure 9:
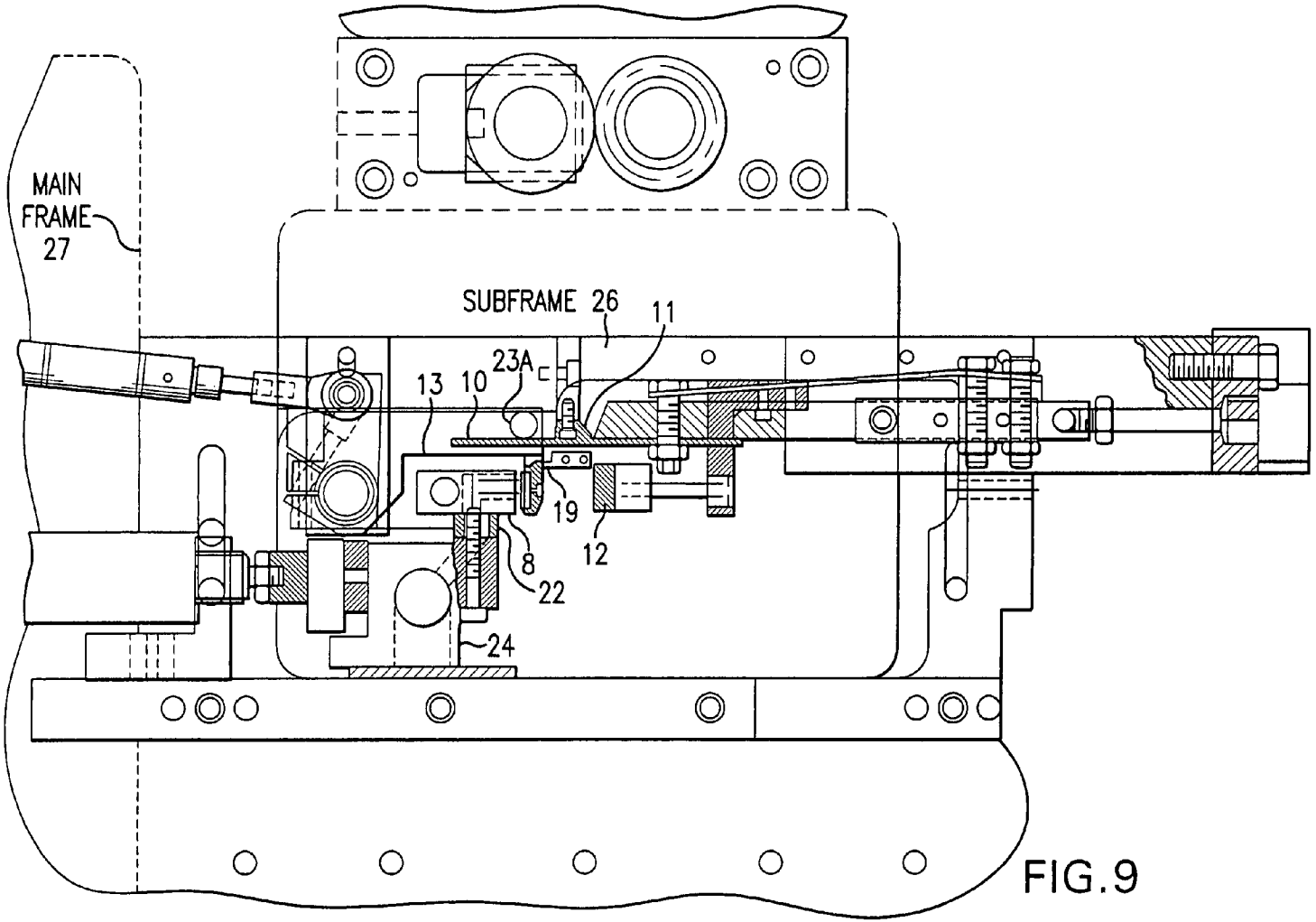
FIG. 9 is a side view of a cut-off and flap making station.

After passing through the slitting crush rollers, the following index brings the now slit pouches to the cut-off and flap making station, shown in an enlarged view in FIGS. 6A-6D. As can be seen in FIG. 9, the cut-off and flap making station may be mounted in a vertically adjustable sub-frame in order to easily modify the length of the pouch by raising or lowering the sub-frame to make the desired adjustment.

The cut-off mechanism in the cut-off and flap making station comprises a reciprocating horizontal knife blade 10 cutting the film against a fixed anvil knife 11. Simultaneous with or proximate in time to the cutting action above, the unfilled portion above the bulge of the filled pouch beneath the knife may be compressed against a properly positioned reciprocating heated vacuum bar 8 and a horizontal reciprocating pressure bar 12 opposing it. The pressure bar 12 bar compresses the flat unfilled portion of the pouch 16 just above the bulge formation 17 which, by virtue of vacuum suction holds the row of pouches firmly. This position is shown in FIG. 6A.

Figure 6B:
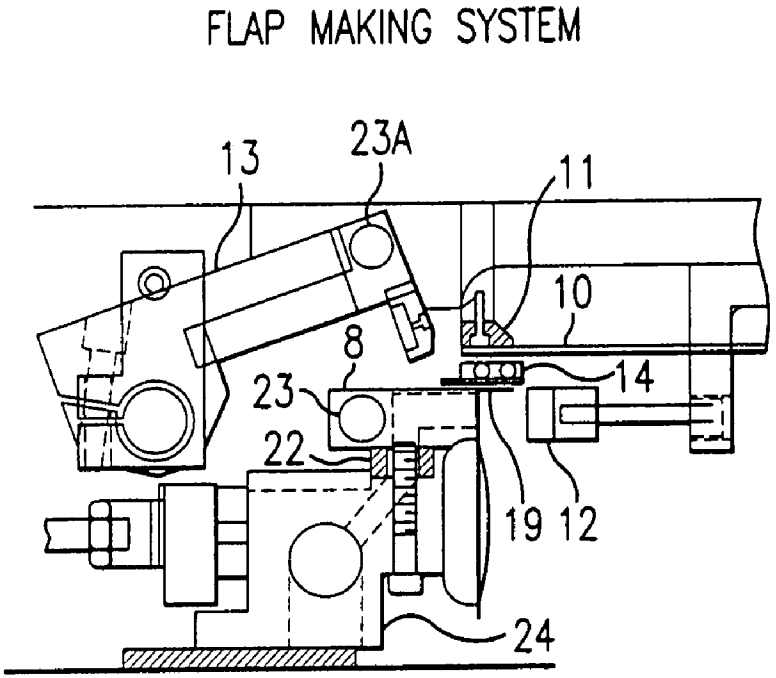
FIG. 6B is an enlarged view of a flap making system of the machine of FIG. 1, showing the flap making system in a second position.
Figure 6A:
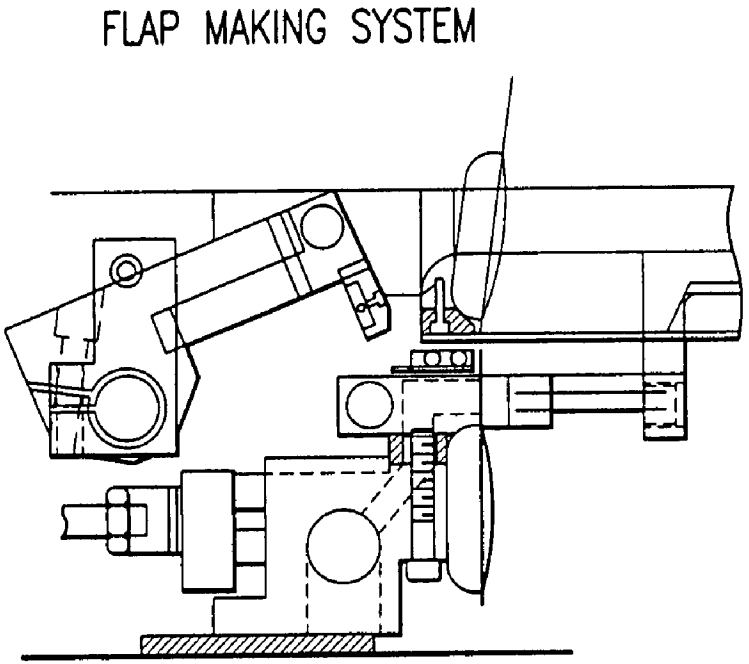
FIG. 6A is an enlarged view of a flap making system of the machine of FIG. 1, showing the flap making system in a first position.
Figure 6D:
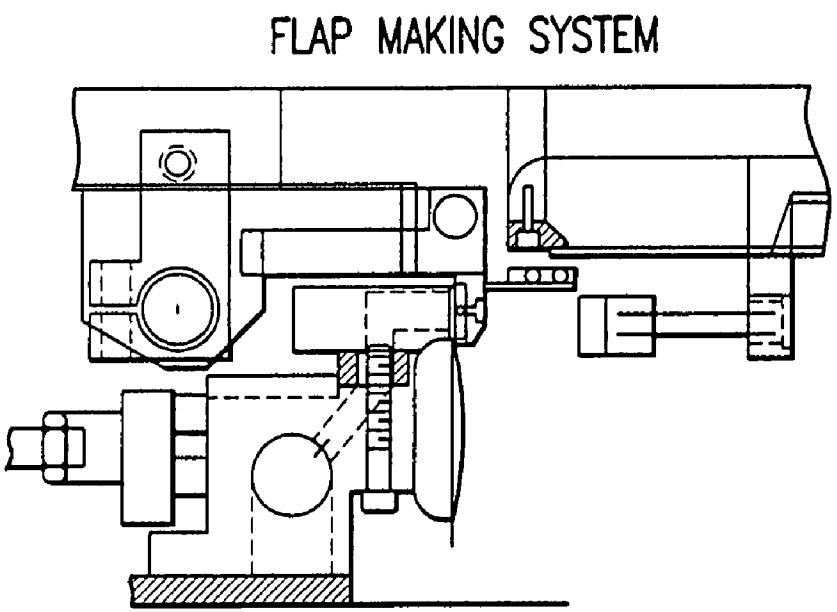
FIG. 6D is an enlarged view of a flap making system of the machine of FIG. 1, showing the flap making system in a fourth position.
Figure 6C:
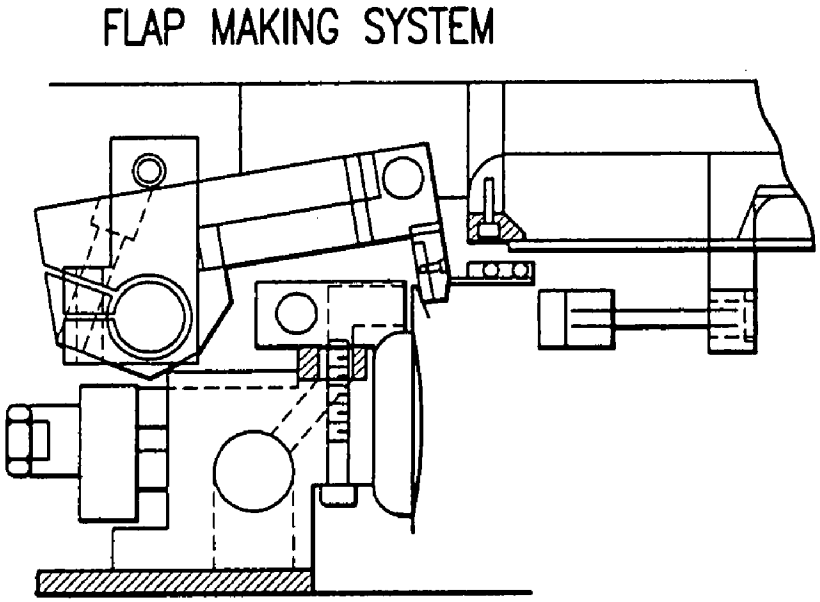
FIG. 6C is an enlarged view of a flap making system of the machine of FIG. 1, showing the flap making system in a third position.

As shown in FIG. 6B, the heated vacuum bar 8 then travels backwards, drawing the pouches with it under a fixed horizontal folder bar 14. The horizontal folder bar 14 wipes the flat unfilled portion of the pouch into a horizontal position at right angles to the walls of the pouch, as shown in FIG. 6B. As shown in FIG. 6C, the heated vacuum bar 8 travels backwards to a controlled stop point, at which time a heated flap folder 13 instantly swivels downward. FIG. 6C shows the heated flap folder 13 as it is being swiveled. The heated flap folder 13 is swiveled into a position parallel to and facing the vacuum bar 8, as shown in FIG. 6D. The heated flap folder 12 faces the vacuum bar 8 with a small clearance space (for example, approximately 0.050") between it and the heated face of the vacuum bar, folding the flap parallel to its own face.

The flap 19, which is folded over, has two walls. Consequently, the flap sealing heat of both the vacuum bar and the folder bar must each pass through two layers of plastic film. If the proper material is not used, this sealing heat could seal together the inside walls of the flap as well as those of the pouch beneath the flap, thereby rendering the pouch functions inoperable. Thus, certain embodiments of the invention preferably use film as described in U.S. Pat. No. 6,415,939 and U.S. patent application Ser. No. 10/189,595, now U.S. Pat. No. 6,685,058, e.g., a multi-layer plastic film where the sealing surface of the flap that is sealed to its own surface seals at a much lower temperature than the surfaces and the inner walls of the flap.

For example, the film may be selected such that the flap seals to its own surface at 175° F. while inner surfaces seal at 240° F. The temperatures in both the heated vacuum bar and the flap folder bar are very accurately controlled so as not to cause this sealing of the inner flap and pouch surfaces. The heated vacuum bar 8 is heated by a heater 23, and the heated swiveled flap folder is heated by a heater 23A. (Vacuum manifold 24 and insulated spacer 22 are also shown.) The instant that the folder bar is in position, the heated vacuum bar advances forward and compresses the flap against the heated folder bar which acts as the vacuum bar's stop, sealing the flap to its own surface. Just as the vacuum bar starts retracting, the flap folder bar may swivel upward and away, the vacuum may then cut off instantly, thereby releasing the now complete pouch with flap sealed over the outlet location, which then drops onto a conveyor.

It will be further understood that the flap folder may fold a number of pouches in a row across the machine. To do this, both the swiveling flap folder bar and the fixed folder bar may be formed with alternate "teeth" so that the fixed bar can remain in place to hold the flap horizontal while the swiveling flap folder bar passes through the interstices between to fold the flap down.

Figure 7A:
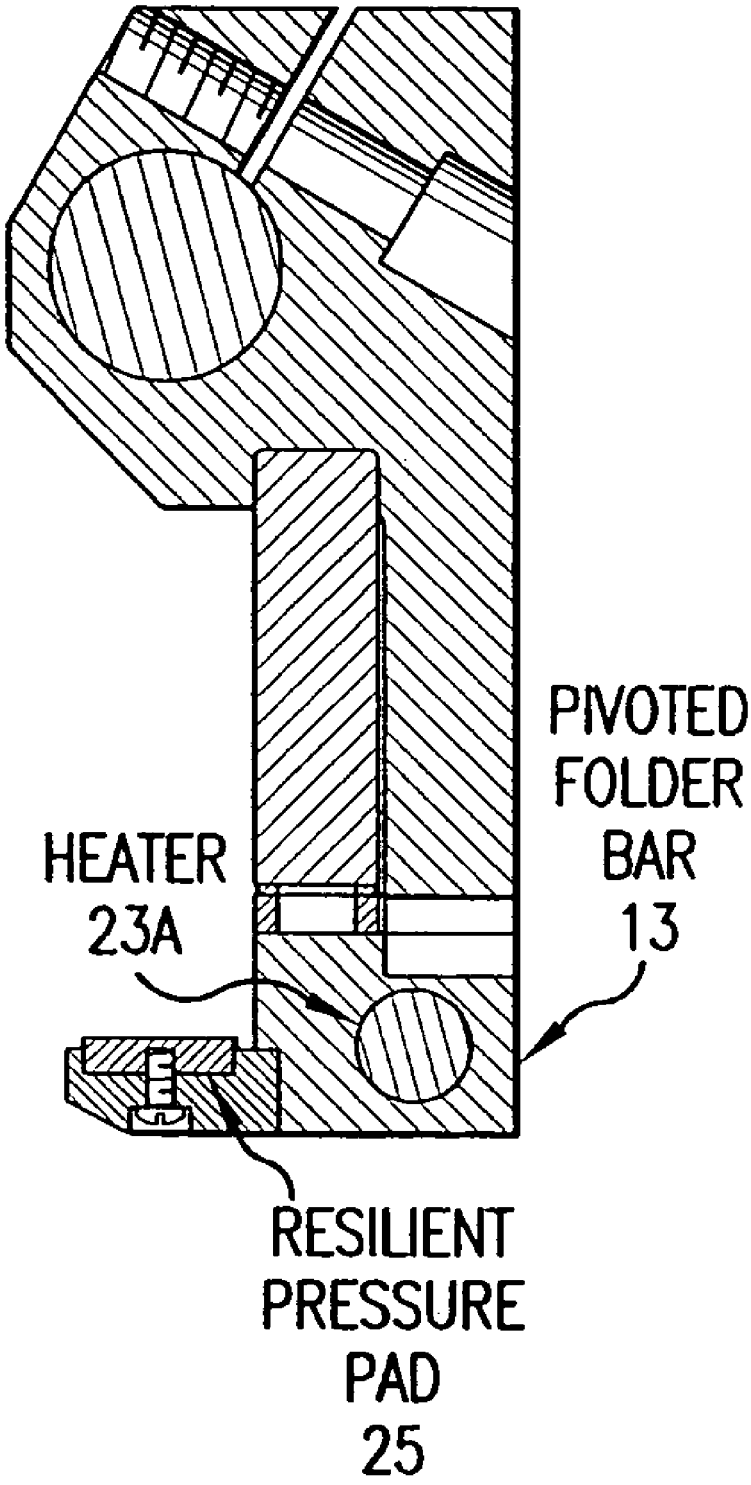
FIG. 7A is an enlarged end view of the pivoted folder bar of the flap making machine of FIG. 1.
Figure 7B:
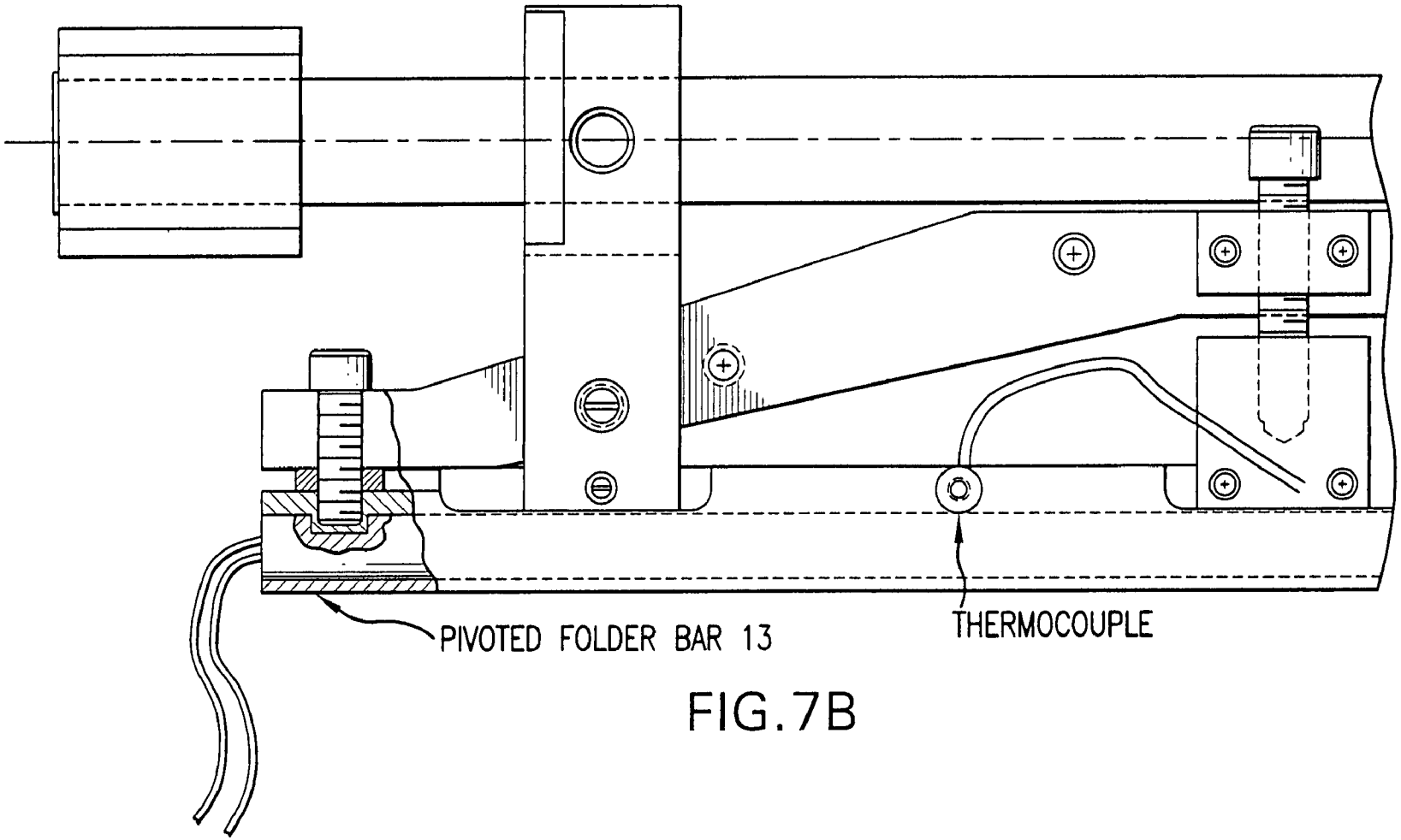
FIG. 7B is a plan view of the pivoted folder bar of FIG. 7A.
Figure 7C:
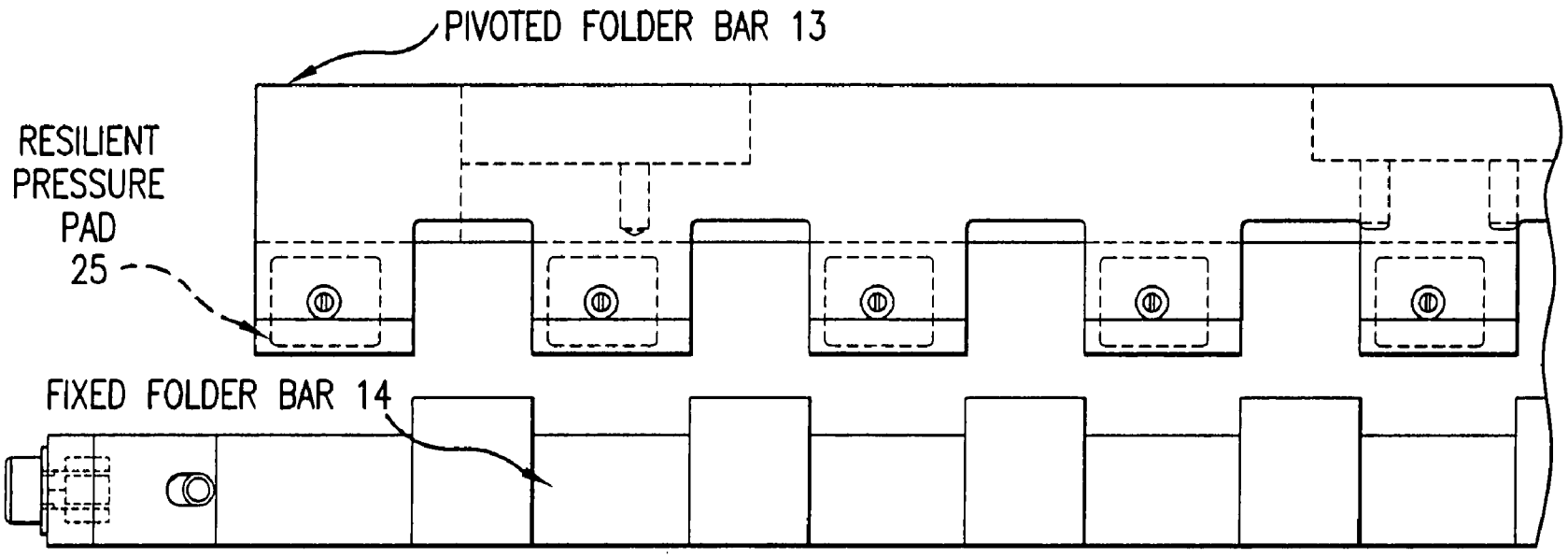
FIG. 7C is a front view of the pivoted folder bar of FIG. 7A.
Figure 7D:
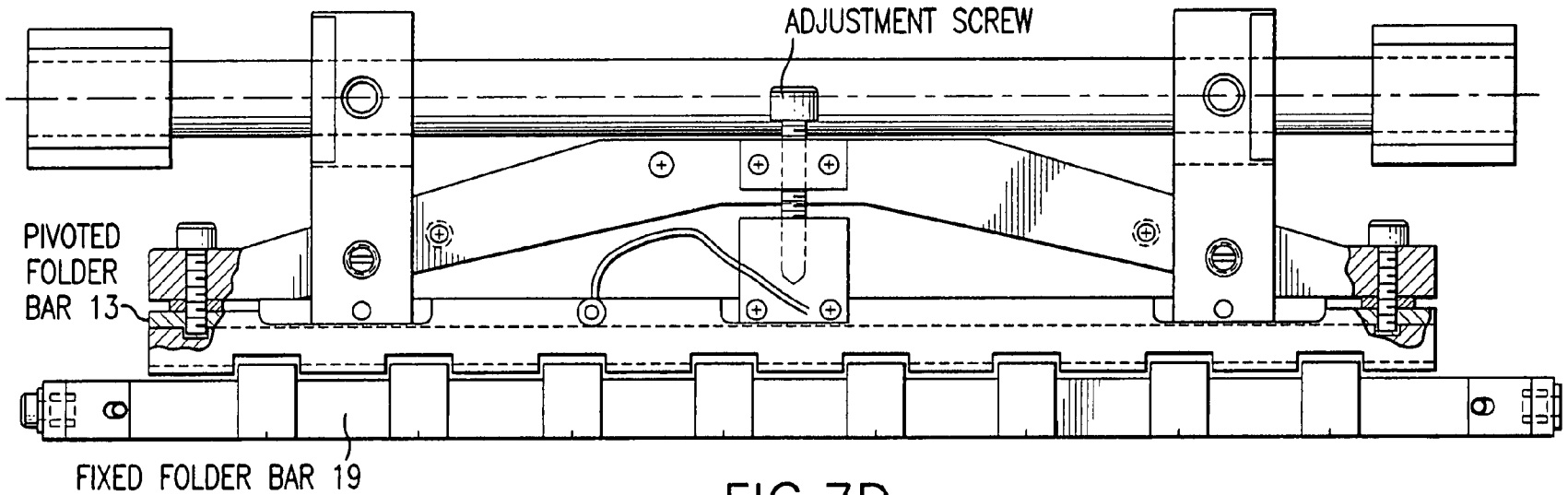
FIG. 7D is a side view of the pivoted folder bar and fixed folder bar during a work stroke of the machine of FIG. 1.

FIGS. 7A through 7D show further details of the flap folder bar 13 and fixed folder bar 14. As shown in FIG. 7A, the flap folder bar 13 has a resilient pressure pad 25 at each location where the bar 13 contacts the package. The alternate "teeth" can be seen in FIG. 7C. FIG. 7D shows the fixed folder bar's "teeth" projecting into the pivoted folder bar's "teeth."

FIGS. 8A through 8C show further details of a sealing die 3. At the lower edge of each sealing location in the seal die 3 is a sealing element 30. This seal element 30 forms a seal in the package to help control the flow out of the aperture once the package is opened.

FIG. 9 shows a vertically adjustable sub-frame 26. This sub-frame and its accompanying controls and actuators, enables the cut-off and flap producing station mounted therein to be adjusted vertically. This vertical adjustment allows the mechanism to produce longer or shorter pouches as the sub-frame is adjusted up or down.

Various aperture forming means may be utilized which require either a punch station, scoring station or a breakaway tip, etc. These can all be mounted on various portions of the machine frame as well as elsewhere. This includes where the second film or web is intermittently traveling horizontally before it goes into its vertical travel or is traveling vertically before or within the machine.

A unit for printing UV curing adhesives and/or inks may be mounted on the machine. This may be used as an alternative means for sealing the flap, such that one of the heat sealing films on the flap wall as described above may be rendered unnecessary. Also, constant draw rollers may be utilized to feed the film from roll stock, eliminating the requirement to start and stop (brake) the rolls, in which case a small dancer roller would take up the slack created by the intermittently acting draw roller.

It will be appreciated by persons of ordinary skill in the art that many modifications may be made without departing from the invention as defined by the claims. For example, certain inventive elements of the machine may be used in combination with other elements. Parts of the depicted machine may be omitted or modified, consistent with the scope of the claims. Machines in accordance with the invention may be used to produce a variety of pouch designs from a variety of film combinations, including but not limited to pouches with flaps, reclosable pouches, and/or other containment and dispensing packages with breakaway tips. For example, the aperture creating die set may be replaced with a breakaway tip and hinge cap forming means to create structures such as those depicted in FIGS. 4, 5, and 6 of U.S. Pat. No. 6,415,939 or others.

I claim:

1. A form-fill-seal machine for making an instant opening containment and dispensing pouch, comprising:

(a) support and braking means for at least two opposing continuous film supplies which are intermittently, simultaneously unwound by a controllable motor;

(b) a bulge forming station comprising:

a pressure bar; and a bulge forming die;

wherein, in the bulge forming station, at least one of said film supplies is forced into the die, forming a puff or bulge in the film;

(c) a heating and sealing and filling station comprising:

reciprocating seal dies; and a filler nozzle;

wherein the reciprocating seal dies come together to create edge seals between at least two of said film supplies, forming a pouch to be filled, and wherein the pouch is filled by dispensing a product through the filler nozzle;

(d) an aperture means creating station wherein at least one of said film supplies is intermittently indexed through said aperture means creating station; and (e) a flap making station comprising means for folding over a portion of the pouch to form a flap and pressing the flap against a surface of the pouch to seal the flap, wherein the means for folding over a portion of the pouch to form a flap and pressing the flag against a surface of the pouch to seal the flap comprises a folder bar and flap folder.

2. A form-fill-seal machine as claimed in claim 1, wherein the aperture means creating station comprises a punch means for forming an aperture in said at least one of said film supplies that is intermittently indexed through said aperture means creating station.

3. A form-fill-seal machine as claimed in claim 2, wherein the means for folding over a portion of the pouch to form a flap and pressing the flap against a surface of the pouch to seal the flap seals the flap over the aperture.

4. A form-fill-seal machine as claimed in claim 1, wherein the aperture means creating station comprises means for creating a breakaway tip structure in said at least one of said film supplies that is intermittently indexed through said aperture means creating station.

5. A form-fill-seal machine as claimed in claim 4, wherein the means for folding over a portion of the pouch to form a flap and pressing the flap against a surface of the pouch to seal the flap seals the flap over the breakaway tip structure.

6. A form-fill-seal machine as claimed in claim 1, wherein the aperture means creating station comprises means for creating a fault line in said at least one of said film supplies that is intermittently indexed through said aperture means creating station.

7. A form-fill-seal machine as claimed in claim 6, wherein the means for folding over a portion of the pouch to form a flap and pressing the flap against a surface of the pouch to seal the flag seals the flap over the fault line.

8. A form-fill-seal machine as claimed in claim 1, wherein the aperture means creating station comprises means for creating a score line in said at least one of said film supplies that is intermittently indexed through said aperture means creating station.

9. A form-fill-seal machine as claimed in claim 8, wherein the means for folding over a portion of the pouch to form a flap and pressing the flag against a surface of the pouch to seal the flap seals the flap over the score line.

10. A form-fill-seal machine as claimed in claim 1 wherein the folder bar and flap folder are each dentilated so as to mesh when forming said flap.

11. A form-fill-seal machine as claimed in claim 1 wherein the bulge forming station forms a puff or bulge in the film by thermoforming.

12. A form-fill-seal machine for making an instant opening containment and dispensing pouch, comprising:

(a) at least two rolls of film, each roll of film comprising a film of laminated plastic and foil;

(b) draw means for drawing said films in a direction of travel through said form-fill-seal machine;

(c) a bulge forming station comprising:

a pressure bar; and a bulge forming die;

wherein, in the bulge forming station, at least one of said films is forced into the die, forming a puff or bulge in the film;

(d) a heating and sealing and filling station comprising:

reciprocating seal dies; and a filler nozzle;

wherein the reciprocating seal dies come together to create edge seals between at least two of said films, forming a pouch to be filled, and wherein the pouch is filled by dispensing a product through the filler nozzle;

(e) slitting means for slitting said films along the direction of travel; and (f) cut-off means for cutting said films transverse to the direction of travel to cut off individual pouches.

13. A form-fill-seal machine as claimed in claim 12 wherein the slitting means comprises slitting anvil rollers and slitting crush rollers.

14. A form-fill-seal machine as claimed in claim 13 wherein the slitting crush rollers are "V" shaped and the slitting anvil rollers have grooves to track the "V" shaped slitting crush rollers.

15. A form-fill-seal machine as claimed in claim 12 wherein the bulge forming station forms a puff or bulge in the film by thermoforming.

16. A form-fill-seal machine as claimed in claim 12 wherein the slitting means slits said films after said films have passed through the heating and sealing and filling station.

17. A form-fill-seal machine for making an instant opening containment and dispensing pouch, comprising:

(a) at least two rolls of film, each roll of film comprising a film of laminated plastic and foil;

(b) draw means for drawing said films in a direction of travel through said form-fill-seal machine;

(c) a bulge forming station comprising:

a pressure bar; and a bulge forming die;

wherein, in the bulge forming station, at least one of said films is forced into the die, forming a puff or bulge in the film;

(d) a heating and sealing and filling station comprising:

reciprocating seal dies; and a filler nozzle;

wherein the reciprocating seal dies come together to create edge seals between at least two of said films, forming a pouch to be filled, and wherein the pouch is filled by dispensing a product through the filler nozzle;

(e) slitting means comprising slitting anvil rollers and slitting crush rollers for slitting said films after passing through the heating and sealing and filling station, wherein the slitting crush rollers are "V" shaped and the slitting anvil rollers have grooves to track the "V" shaped slitting crush rollers; and (f) a cut-off knife blade and fixed anvil knife for cutting said films transverse to the direction of travel to cut off individual pouches.

* * * * *

UNITED STATES PATENT AND TRADEMARK OFFICE

CERTIFICATE OF CORRECTION

PATENT NO. : 7,325,370 B2
APPLICATION NO. : 11/430040
DATED : February 5, 2008
INVENTOR(S) : Sanford Redmond It is certified that error appears in the above-identified patent and that said Letters Patent is hereby corrected as shown below:

Column 6, Line 26 “flag” should be --flap--

Column 6, Line 55 “flag” should be --flap --

Column 6, Line 63 “flag” should be --flap--

Signed and Sealed this

Twenty-fourth Day of June, 2008

JON W. DUDAS
*Director of the United States Patent and Trademark Office*